US007584585B2

(12) United States Patent
Kilby

(10) Patent No.: US 7,584,585 B2
(45) Date of Patent: Sep. 8, 2009

(54) NON METALLIC REBAR SUPPORT

(76) Inventor: Harold J. Kilby, P.O. Box 608, Camp Verde, AZ (US) 86322

( * ) Notice: Subject to any disclaimer, the term of this patent is extended or adjusted under 35 U.S.C. 154(b) by 432 days.

(21) Appl. No.: 11/165,918

(22) Filed: Jun. 24, 2005

(65) Prior Publication Data

US 2007/0011985 A1 Jan. 18, 2007

(51) Int. Cl.
*E04C 5/07* (2006.01)

(52) U.S. Cl. ..... 52/677; 52/682

(58) Field of Classification Search ..... 52/633, 52/677, 687, 685, 682, 163, 166, 98, 99, 52/100; 404/134–136, 74; 248/346.03, 440, 248/71, 74.2, 74.4, 156, 65, 68.1, 511, 519, 248/523, 530, 534, 539, 27.8; 174/50; 47/70
See application file for complete search history.

(56) References Cited

U.S. PATENT DOCUMENTS 1,212,843 A * 1/1917 Struchen ..... 52/700
2,439,428 A * 4/1948 Hillberg ..... 404/62
3,006,115 A * 10/1961 Hillberg ..... 52/365
3,255,565 A * 6/1966 Menzel ..... 52/678
3,295,806 A * 1/1967 Modeme ..... 248/74.4
3,300,930 A * 1/1967 Weise ..... 52/309.1
3,360,898 A * 1/1968 Beckman ..... 52/684
3,367,084 A * 2/1968 Reiland ..... 52/649.7
3,471,987 A * 10/1969 Yelsma ..... 52/684
3,512,330 A * 5/1970 Shlesinger ..... 52/677
3,529,392 A * 9/1970 Adams ..... 52/687
3,552,696 A * 1/1971 Orenick et al. ..... 248/74.3
3,693,310 A * 9/1972 Middleton ..... 52/685
3,694,989 A * 10/1972 Oliver et al. ..... 52/678
3,788,025 A * 1/1974 Holmes ..... 52/685
3,830,032 A * 8/1974 Robb ..... 52/687
3,839,838 A * 10/1974 Vigh ..... 52/687
4,033,534 A * 7/1977 Bergkvist ..... 248/49
4,099,354 A 7/1978 DePirro
4,100,834 A 7/1978 Harris
4,158,937 A * 6/1979 Henry ..... 52/365
4,239,176 A * 12/1980 Salazar ..... 249/97
4,450,605 A * 5/1984 Schaty ..... 24/457
4,541,602 A * 9/1985 Potzas ..... 248/544
4,550,891 A * 11/1985 Schaty ..... 248/68.1
4,575,985 A * 3/1986 Eckenrodt ..... 52/677
4,641,478 A * 2/1987 Nelson, Jr. ..... 52/704

(Continued)

*Primary Examiner*—Richard E Chilcot, Jr.
*Assistant Examiner*—Alp Akbasli
(74) *Attorney, Agent, or Firm*—Raymond M. Galasso; Galasso & Associates, L.P.

(57) ABSTRACT

A rebar support is provided through an arm-type apparatus, which may have a plurality of dimensions for different concrete constructions. A tube in the apparatus is slid over an upright support such as a grade stake to hold the apparatus in place. Multiple instances of the apparatus may thus be placed over multiple stakes to hold rebar in the correct position for the grid pattern required to strengthen the concrete in a particular structure. Rebar may then be quickly and securely snapped into notches on the apparatus without tying or extensive training of personnel. In an embodiment different designs of the apparatus are provided with notches designed to fit rebar of different diameters. In another embodiment snap-out tabs in the notches are used so that one design of the apparatus may be employed with rebar with different dimensions. The apparatus may be Y-shaped to further strengthen the arms.

6 Claims, 1 Drawing Sheet

U.S. PATENT DOCUMENTS 4,835,933 A * 6/1989 Yung ..... 52/685
4,874,149 A * 10/1989 Miceli ..... 248/530
5,002,243 A * 3/1991 Kraus et al. ..... 248/68.1
5,033,701 A * 7/1991 Kraus ..... 248/68.1
5,107,654 A * 4/1992 Leonardis ..... 52/685
5,400,562 A * 3/1995 Bahr ..... 52/684
5,729,949 A * 3/1998 Hartzheim ..... 52/677
5,791,816 A * 8/1998 McCallion ..... 404/136
5,797,231 A * 8/1998 Kramer ..... 52/396.02
6,089,522 A * 7/2000 Haslem et al. ..... 248/440
6,354,054 B1 * 3/2002 Verelli et al. ..... 52/686
6,389,774 B1 * 5/2002 Carpenter ..... 52/585.1
6,447,203 B1 * 9/2002 Ruiz et al. ..... 404/70
6,663,316 B1 * 12/2003 Harris ..... 404/136
6,732,484 B1 * 5/2004 Sotelo et al. ..... 52/687
6,883,289 B2 * 4/2005 Juedes et al. ..... 52/687
6,926,237 B2 * 8/2005 Shereyk et al. ..... 248/71
7,086,203 B2 * 8/2006 Owen ..... 52/126.6
D548,053 S * 8/2007 Erickson et al. ..... D8/354
7,267,307 B2 * 9/2007 Bauer ..... 248/65
2002/0063189 A1 * 5/2002 Coudrais ..... 248/68.1
2004/0113027 A1 * 6/2004 Nakanishi ..... 248/68.1
2007/0157542 A1 * 7/2007 Peterson ..... 52/677

* cited by examiner

NON METALLIC REBAR SUPPORT

FIELD OF THE DISCLOSURE

The invention relates to an apparatus for raising and securing rebar together to form a grid pattern for reinforcing concrete.

BACKGROUND

Concrete is used extensively in the construction industry for a wide range of commercial buildings, family dwellings, and other structures. For example, concrete footers are used for basements and garage floors, and concrete is the major material used for constructing foundations, walls, and floors.

To add greater strength and stability, concrete is typically poured over metal bars called rebar in a grid pattern that must be configured accurately, at the correct height and width for the structure being built; To form this grid pattern, workers trained for the task typically tie the rebar securely in place to the grade stakes that are used to mark the correct height and width for the concrete when the concrete is poured. However, the process of manually tying rebar in place is laborious, time-consuming, and therefore expensive. In addition, rebar is often tied to steel beams to maintain the upright parts of the grid, but this practice is against many governmental codes for construction.

Because of the disadvantages associated with manually tying rebar, tools have also been designed to aid in forming rebar into a grid pattern. For example, U.S. Pat. No. 6,871,471 for Davidson provides the following apparatus:

"An apparatus for positioning rebar for reinforcing concrete, wherein the apparatus includes a semi-cylindrical portion configured for receiving a first rebar extending in a first direction, wherein the semi-cylindrical portion defines first and second opposing straight edges, and two opposing semi-circular ends. A first flange portion extends outwardly from the first straight edge, and a second flange portion extends outwardly from the second straight edge. First and second receiver portions extend longitudinally from the respective first and second flanges beyond one of the ends for receiving a second rebar extending in a second direction substantially orthogonal to the first direction, and for urging the second rebar against the first rebar. Optionally, legs extend from or are attached to the apparatus for supporting the apparatus in an elevated position."

However, the flanges for the apparatus described above represent an unnecessarily complicated configuration that may be expensive to produce and difficult to employ. Moreover, the options legs represent an additional and potentially unnecessary expense.

Therefore, there is a need for a less complicated and easier to use apparatus that holds rebar in place without tying, for the appropriate grid pattern used to strengthen concrete for construction.

SUMMARY OF THE DISCLOSURE

The following explanation describes the present invention by way of example and not by way of limitation.

It is an aspect of the present invention to provide an apparatus that holds rebar securely in place without tying, for the appropriate grid pattern used to strengthen concrete for construction.

It is another aspect of the present invention to provide an apparatus that holds rebar securely in place without tying and that may be used in association with grade stakes.

It is another aspect of the present invention to provide an apparatus that holds rebar securely in place in notches.

It is another aspect of the present invention to provide an apparatus that holds rebar securely in place in notches with snap-out tabs to accommodate rebar with multiple dimensions.

These and other aspects of the present invention will become readily apparent upon further review of the following specification and associated drawings. In accordance with the present invention, a rebar support is provided through an arm-type apparatus, which may have a plurality of dimensions for different concrete constructions. A tube in the apparatus is slid over an upright support such as a grade stake to hold the apparatus in place. Multiple instances of the apparatus may thus be placed over multiple stakes to hold rebar in the correct position for the grid pattern required to strengthen the concrete in a particular structure. Rebar may then be quickly and securely snapped into notches on the apparatus without tying or extensive training of personnel. In an embodiment different designs of the apparatus are provided with notches designed to fit rebar of different diameters. In another embodiment snap-out tabs in the notches are used so that one design of the apparatus may be employed with rebar with different dimensions. The apparatus may be Y-shaped to further strengthen the arms.

BRIEF DESCRIPTION OF THE DRAWINGS

The following embodiments of the present invention are described by way of example only, with reference to the accompanying drawings, in which.

DETAILED DESCRIPTION OF THE DRAWINGS

Figures 1, 2:
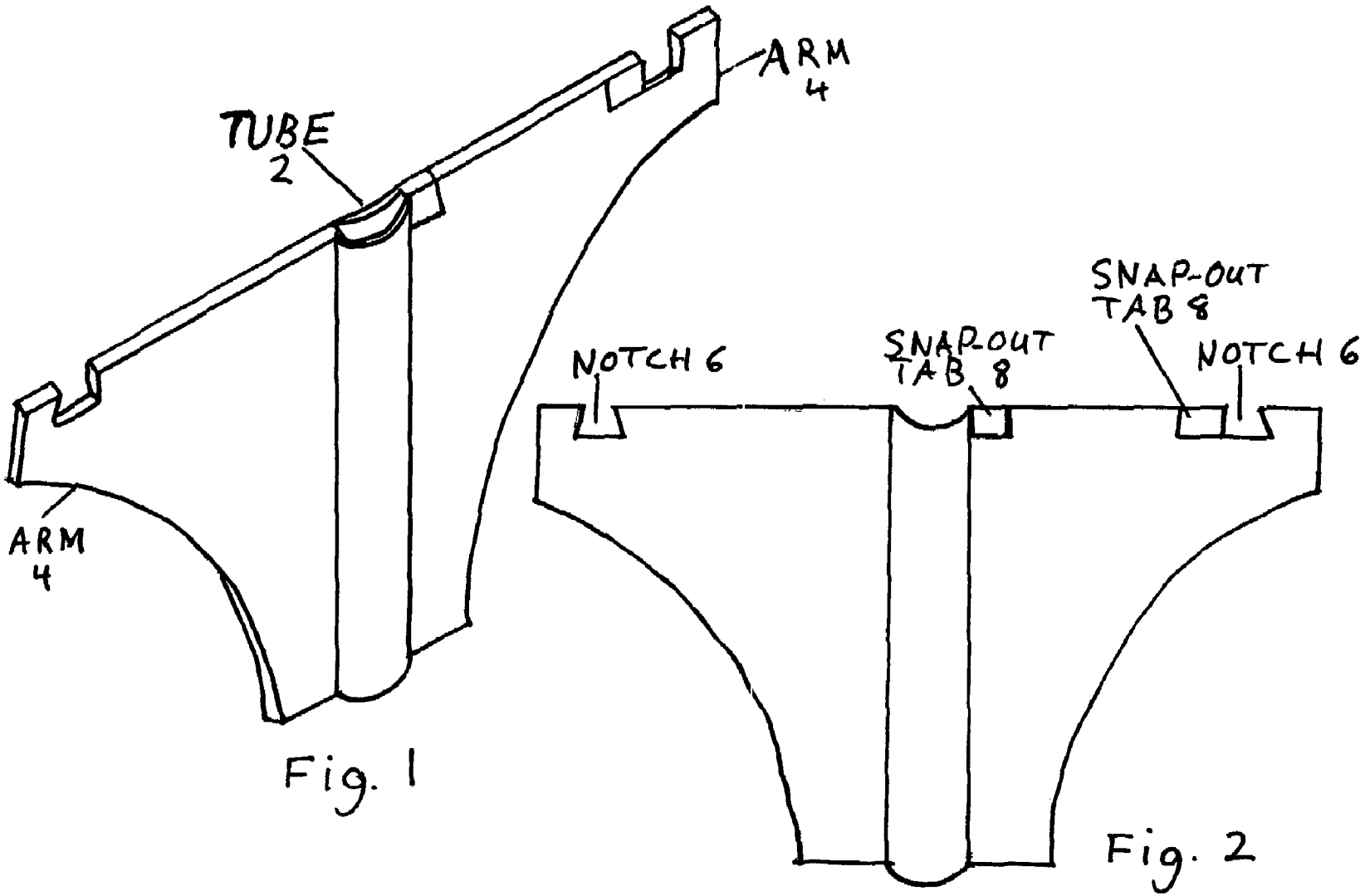
FIG. 1 illustrates a side view of a Non-Metallic Rebar Support.
FIG. 2 illustrates a front view of a Heavy Non-Metallic Rebar Support.

The following description of drawings is offered to illustrate the present invention clearly. However, it will be apparent to those skilled in the art that the concepts of the present invention are not limited to these specific details. Also, commonly known elements are shown in diagrams for clarity, as examples only and not as limitations of the present invention.

FIG. 1 illustrates a side view of an embodiment of a Non-Metallic Rebar Support, which is an arm-type device that holds rebar at the correct height, width, and long ways and crossways position for forming a grid pattern used to strengthen concrete. The Non-Metallic Rebar Support may be constructed of the best quality materials accepted and used by the manufacturing industry. This material may be lightweight and should be long lasting and durable enough to support rebar in a grid pattern over which concrete may be poured. For example, it may be constructed of thermoplastics such as polyethylene or polypropylene, which are recognized in the industry as being versatile, durable, and of high quality.

In embodiments, the Non-Metallic Rebar Support measures one foot to four feet in length by one foot to four feet in height by eight inches to two feet in width, all depending on the size and depth of the concrete section being poured.

In an embodiment, the Non-Metallic Rebar Support is Y shaped, which adds strength to each arm to support the rebar.

In an embodiment, the Non-Metallic Rebar Support comprises the following elements:

A tube 2,

Arms 4, and

Notches 6.

In another embodiment, the Non-Metallic Rebar Support comprises the elements listed above and snap-out tabs 8.

The tube 2 is hollow and slides down over the grade stakes typically used to mark the correct height and width for concrete when the concrete is poured or other upright supports. In an embodiment, the tube 2 is located in the center of the apparatus, as shown in FIG. 1. In different embodiments, the aperture of the tube 2 may be of different sizes, to accommodate grade stakes or upright supports of different sizes. Moreover, in other embodiments the tube may not be central to the apparatus, but may be located elsewhere, as may be advantageous and useful.

As mentioned above, in an embodiment the arms 4 may comprise a Y shape to add strength to the Non-Metallic Rebar Support.

As shown in FIG. 2, on top of the arms 4 are preformed notches 6 that the rebar snaps into. In an embodiment, different instances of the Non-Metallic Rebar Support may have notches 6 designed to accommodate specific sizes of rebar. For example, one instance may have notches 6 that fit rebar with a diameter of three eights of an inch. Another instance may have notches 6 that fit rebar with a one half inch diameter, and a third may have notches 6 that fit rebar with a diameter of three fourths of an inch. In an embodiment the notches 6 may be semi-circular to better fit the shape of the rebar.

In another embodiment the Non-Metallic Rebar Support may comprise notches 6 with at least one snap-out tab 8, so that a single Non-Metallic Rebar Support may accommodate rebar of multiple diameters.

In different embodiments, the location of the notches 6 and snap-out tabs 8 on the Non-Metallic Rebar Support may be designed to accomplish different rebar grid patterns, as advantageous and useful. For example, the notches 6 and snap-out tabs 8 may be located toward the end of the arms 4 as well as closer to a central tube 2.

Use

To employ the Non-Metallic Rebar Support, an appropriate design of the Non-Metallic Rebar Support is provided for the size and depth of the concrete section being poured. For example, for shallow concrete a Non-Metallic Rebar Support that is one foot in length, one foot in height, and eight inches in diameter may be appropriate. For deeper concrete, dimensions of four feet in length, four feet in height, and two feet in width may be more appropriate.

A person slides the tube 2 of a Non-Metallic Rebar Support over an existing grade stake or upright support. In this way, a configuration of individual Non-Metallic Rebar Supports may be placed at the correct height and width to form the grid pattern required to strengthen the concrete in the particular structure to be built. The Non-Metallic Rebar Support may by rotated around the axis formed by the grade stake or upright support to the correct long ways or crossways position for forming the required grid pattern.

For most concrete the height of the Non-Metallic Rebar Support would provide the required height for the rebar. If more height is required, PVC plastic sleeves cut to the desired length can be dropped on the grade stake below the Non-Metallic Rebar Support. If multiple heights of horizontal rebar are required, the Non-Metallic Rebar Supports can be stacked on the grade stakes with PVC plastic sleeves to achieve the desired spacing.

Once the required configuration of individual Non-Metallic Rebar Supports is in place, the rebar may be snapped securely into position on the notches 6, quickly, efficiently, and without tying. No extensive training is required for placing the rebar on the Non-Metallic Rebar Supports.

In an embodiment, Non-Metallic Rebar Supports are used with notches 6 that fit the specific diameter of the rebar being employed in the construction, and the rebar is snapped securely into place in the notches 6. For example, Non-Metallic Rebar Supports with notches 6 that fit rebar with a diameter of three eights of an inch may be used with rebar of that size.

In another embodiment, Non-Metallic Rebar Supports are used with notches 6 comprising snap-out tabs 8 to accommodate rebar with multiple dimensions. When the rebar to be used has a diameter that fits securely within the notches 6, the snap-out tabs 8 may be left in place and the rebar may be snapped into the notches 6. When the rebar has a wider diameter than will fit into the notches 6, the snap-out tabs 8 may be quickly pushed out by hand, or by pressing with a portable tool such as a screwdriver, so that the enlarged notches 6 can accommodate the wider rebar.

The best dimensional relationships for the parts of the invention described above, including variations in form and use, will be readily apparent to those skilled in the art, and are intended to be encompassed by the present invention.

What is claimed is:

1. An apparatus that holds rebar in place for forming the grid pattern used to strengthen concrete when the concrete is poured for construction, the apparatus comprising at least two arms comprising a Y shape, a hollow tube approximately center the at least two arms; said hollow tube extending the height of the two arms; the hollow tube operable to slide down over grade stakes one or more notches located on the arms; and at least one snap-out tab adjacent the one or more notches and operable to increase the size of the notch.

2. The central tube of claim 1, wherein the central tube comprises a plurality of apertures with dimensions that fit over a plurality of grade stakes with different dimensions.

3. The notches of claim 1, wherein the notches comprise preformed notches with a plurality of diameters that fit a plurality of rebar with different diameters.

4. The notches of claim 1, wherein the notches comprise semi-circular notches.

5. An apparatus that holds rebar in place for forming the grid pattern used to strengthen concrete when the concrete is poured for construction, the apparatus comprising a device with arms, wherein the device with arms comprises a Y shape;

a central tube extending the height of the Y-shaped arms, wherein the central tube comprises an aperture that fits over a grade stake used in concrete construction; and preformed notches, wherein the preformed notches comprise semi-circular notches; and snap-out tabs operable to increase the size of the notches.

6. The central tube of claim 5, wherein the central tube comprises a plurality of apertures with dimensions that fit over a plurality of grade stakes with different dimensions.

* * * * *